US005311851A

United States Patent [19]

Wright, Jr.

[11] Patent Number: 5,311,851

[45] Date of Patent: May 17, 1994

[54] METHANE MONITOR AND ENGINE SHUTDOWN SYSTEM

[76] Inventor: Harold W. Wright, Jr., 2 Begonia, Casper, Wyo. 82604

[21] Appl. No.: 844,166

[22] Filed: Mar. 2, 1992

[51] Int. Cl.[5] ..... F02P 11/00

[52] U.S. Cl. ..... 123/630; 123/198 D; 123/198 DB; 73/118.1; 73/31.01

[58] Field of Search ..... 123/630, 690, 349, 351, 123/352, 494, 513, 479, 1 A, 1 R, 198 D, 198 DB; 417/612; 340/521, 632; 73/1 G, 116, 118, 23.2, 19.01, 31.01

[56] References Cited

U.S. PATENT DOCUMENTS

| | | | |
|---|---|---|---|
| 4,329,954 | 5/1982 | Dobbs | 123/198 DB |
| 4,380,976 | 4/1983 | Bottiglieri | 123/198 DB |
| 4,541,272 | 9/1985 | Bause | 73/118 |
| 4,565,170 | 1/1986 | Grieshaber et al. | 123/198 DB |
| 4,960,087 | 10/1990 | Junginger et al. | 123/630 |
| 4,989,562 | 2/1991 | Ohkumo et al. | 123/198 D |
| 5,036,808 | 8/1991 | Stumpp | 123/198 D |
| 5,069,154 | 12/1991 | Carter | 123/198 D |

FOREIGN PATENT DOCUMENTS

| | | | |
|---|---|---|---|
| 0890196 | 12/1981 | U.S.S.R. | 73/31.01 |
| 1394106 | 5/1988 | United Kingdom | 73/31.01 |

*Primary Examiner*—Raymond A. Nelli

*Attorney, Agent, or Firm*—Risto A. Rinne, Jr.; Douglas M. Clarkson

[57] ABSTRACT

A system is described to detect methane gas at oil well and natural gas well sites that will generate a warning signal when a first, lower concentration of methane gas is detected and will generate a second signal when a higher, more dangerous level of methane gas is detected. A methane monitoring control and sensor device is mounted within the environment of an internal combustion engine and is used to detect the concentration levels of methane gas and to generate two signals. A first signal will generate a warning, and a second signal will affect engine shutdown by means of a compressed air operated valve closing the air intake to the engine.

5 Claims, 1 Drawing Sheet

METHANE MONITOR AND ENGINE SHUTDOWN SYSTEM

BACKGROUND OF THE INVENTION

1. Field of the Invention

The present invention, in general, relates to a system for use with an internal combustion engine at oil well and natural gas well sites and, more particularly, to apparatus to provide a warning and to shut down the operation of an internal combustion engine when a concentration of methane gas is detected that is exceeding a preset level.

Oil wells and natural gas wells require the use of equipment that is powered by internal combustion engines. The equipment is used, for example, to pump well contents to the surface and to operate mobile diagnostic equipment that is periodically inserted into existing wells.

A problem sometimes encountered at oil and/or natural gas well sites is that a hydrocarbon, often in the form of methane gas, is either pumped from or otherwise expelled naturally from such well sites.

Furthermore, it is not possible to accurately predict when a significant quantity of methane gas may be expelled from an oil or gas well into the atmosphere. A rupture of piping may contribute to the release of methane gas, as would normal fluctuations in the substances that are encountered within each well being pumped or tested.

The danger that arises from the release of volatile vapors into the atmosphere occurs when the ambient concentration of hydrocarbons, such as are found in methane gas, increase beyond a safe level. In that event, an internal combustion engine will experience an acceleration, known as engine "run-away".

This occurs because an internal combustion engine reacts to an increased source of energy derived from burning methane gas present in the air. Usually, a concentration level in excess of one percent methane produces the danger of a "run-away" event occurring.

A "run-away" condition also causes the engine to increase its internal operating temperature significantly and may result in the engine expelling glowing particulates from the exhaust stack into the atmosphere. These glowing particulates may ignite the hydrocarbons in the atmosphere immediately outside the engine exhaust stack, resulting in damage or injury.

Accordingly, there exists today a need for a methane monitor and engine shutdown system for use at oil well and natural gas well sites to warn of a possible engine run-away condition.

2. Description of Prior Art

Devices are known that will detect combustible gas at various places. For example, U.S. Pat. No. 2,219,391 to Jacobsen, that issued Oct. 29, 1940, describes an apparatus for automatically indicating and controlling the concentration of a combustible gas or vapor between certain limits, or approaching the lower explosive limit.

U.S. Pat. No. 2,573,390 to Blanchard, that issued Oct. 30, 1951, describes an apparatus for detecting the presence of a gas in drilling mud.

U.S. Pat. No. 3,838,597 to Montgomery et al, that issued Oct. 1, 1974, describes a method and apparatus for monitoring the operation of a pump used in withdrawing fluids from a well by differentiation of an electrical load signals.

U.S. Pat. No. 4,118,148 to Allen, that issued Oct. 3, 1978, describes a system for control of a downhole pump by the displacement of the fluids and gas discharged by the pump.

U.S. Pat. No. 4,507,053 to Frizzell, that issued Mar. 26, 1985, describes an apparatus for shutting down a pump when a pump off condition, such as the detection of an inadequate flow is observed.

U.S. Pat. No. 4,508,488 to Pikna, that issued Apr. 2, 1985, describes apparatus to control the pumping of fluids from a well to optimize flow rates.

U.S. Pat. No. 4,788,529 to Lin, that issued Nov. 29, 1988, describes a gas flow regulator with alarm and control features to close a gas supply when a condition arises.

U.S. Pat. No. 4,859,151 to Reed, that issued Aug. 22, 1989, describes a control device to regulate a pump when the flow rate is less than a predetermined amount.

While the structural arrangements of these devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an important object of the present invention to provide a system to detect a concentration level of combustible hydrocarbons, such as in methane gas, when present in the atmosphere at oil and natural gas well sites.

It is also an object of the invention to provide a warning indicative of the possible occurrence of an engine runaway event at oil and natural gas well sites when the ambient atmospheric concentration of hydrocarbons exceeds a predetermined level.

Another important object of the invention is to provide a reliable system to affect an emergency shutdown for internal combustion engines at oil and natural gas well sites when the ambient atmospheric concentration of hydrocarbons exceeds a predetermined level.

Briefly, a methane monitor and engine shutdown apparatus for use at oil well and natural gas well sites that is constructed in accordance with the principles of the present invention has a methane monitoring control connected to a methane monitoring sensor device, the characteristics of which make it sensitive to methane gas in the atmosphere. When a predetermined unsafe condition develops, such as when the concentration level of ambient methane gas exceeds a predetermined setting, the sensor device generates an output signal causing the methane monitoring control to attenuate the intake air supply of an internal combustion engine, resulting in prompt and safe engine shutdown.

DETAILED DESCRIPTION OF THE INVENTION

Figure 1:
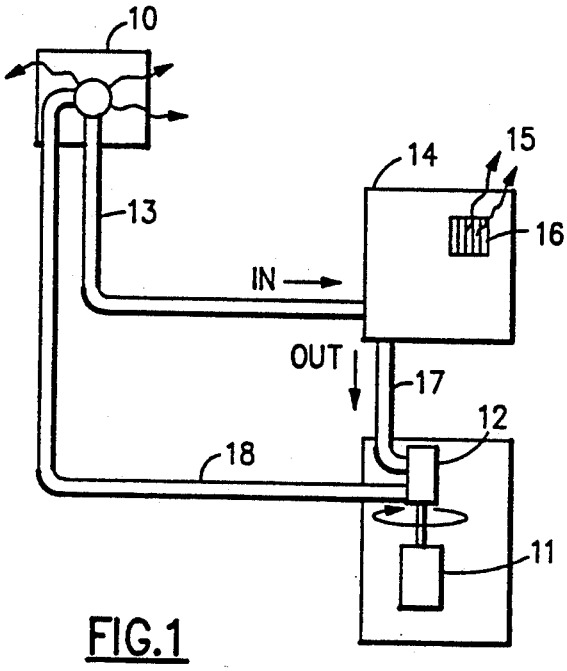
FIG. 1 is a block diagrammatic view of an engine shutdown system, according to the invention, at a typical oil well site.

Referring to FIG. 1, an oil well is identified generally by the numeral 10. An internal combustion engine 11, usually found at an oil well site, is connected to turn a pump 12 to perform the functions such a pump usually performs at an oil well site.

Fluids usually pumped from the oil well 10 flow through a pipe 13 to a storage tank 14 under the action of the pump 12. A purpose of the storage tank 14 is to allow its contents to segregate into layers with the thinner oils and lighter materials, including vapors, migrating to the top and heavier fluids, such as water, migrating at the bottom.

The storage tank 14 is designed typically to release gasses freely, such as methane gas identified by the numeral 15, from a vent 16. The pump 12 is connected to a line 17 and, in turn, to a return line 18 back to the well 10.

A fluid circuit is created by these connections, whereby the storage tank 14 captures the lighter fluids, such as oil, while returning the heavier fluids, such as water, back into the well 10. Methane gas 15 and other gasses that are extracted from the well 10 are released through the vent 16 into the air outside of the storage tank 14.

Figure 2:
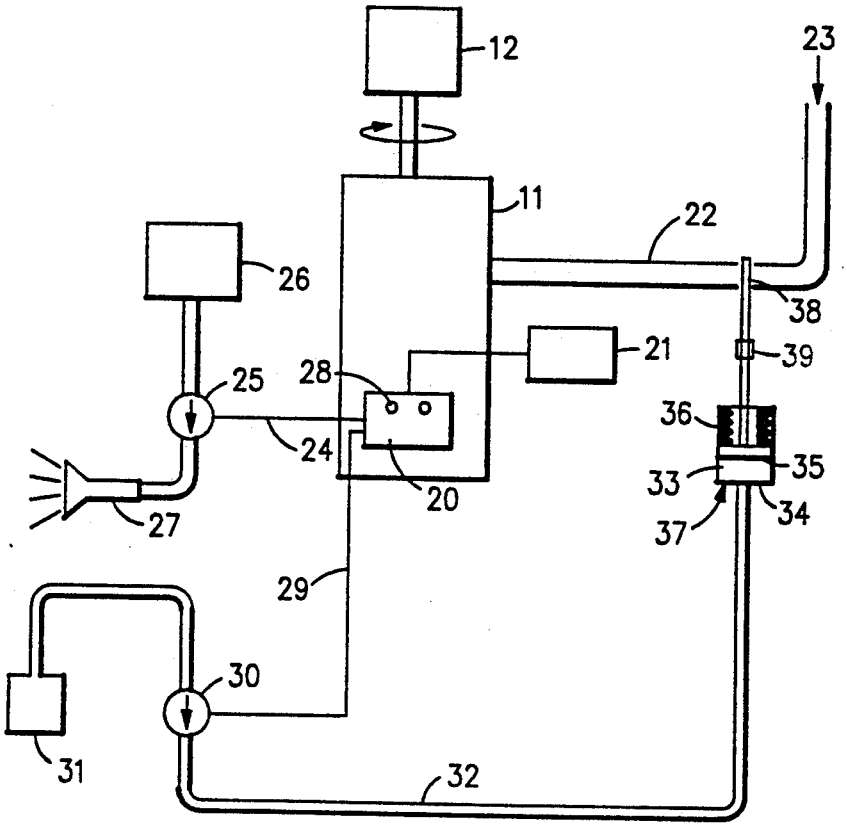
FIG. 2 is a block diagrammatic view in more detail of a presently preferred form of methane monitoring and engine shutdown apparatus attached operatively to an engine connected to a pump at a typical oil well site, illustrating features and advantages of the invention.

In FIG. 2, a more detailed view of the system of the present invention is shown with a methane monitoring control 20 mounted conveniently relative to the engine 11. The methane monitoring control 20, including a sensor head 21, is available commercially from General Monitors Inc. as Model 420.

The sensor head 21 is used to detect the concentration of methane gas 15 present in the atmosphere. The sensor head 21 reacts with the methane gas to give a reading of methane gas converted into percentages and is displayed on a meter.

The remote sensor head 21 is located close to an air intake line 22 for the engine 11. An air intake opening 23 admits air into the air intake line 22 for the engine 11.

The methane monitoring control 20 and the remote sensor head 21 require an electrical source of energy from either an AC or DC voltage source in the twelve to sixteen volt range for operation. Therefore, a twelve volt DC vehicle battery is suitable for operation of the methane monitoring control 20 and remote sensor head 21.

When the methane monitoring control 20 detects methane gas above a preset level, it generates a signal on a connection 24 to energize a solenoid 25, so that compressed air from a source 26 actuates an audible alarm 27. In addition, when the preset level of methane gas is exceeded, an alarm light 28 is illuminated. The alarm light 28 will remain illuminated as long as the preset methane gas level is exceeded or until the methane monitoring control 20 cancels the energizing signal.

The audible warning signal will persist as long as the preset methane gas level is exceeded and until action is taken by appropriate personnel or until the supply of compressed air is exhausted. Of course, the methane monitoring control 20 may be adjusted to cancel the signal on the connection 24.

If the methane gas level continues to rise and reaches a second level, the methane monitoring control 20 energizes a relay (not visible) located within the control 20 to produce an external shutdown signal on a connection 29 to open a shutdown solenoid 30. The air intake side of the shutdown solenoid 30 is connected to a compressed air supply 31, and the air output side is connected through a line 32 to a roto-chamber 33.

When the shutdown solenoid 30 opens, compressed air flows from the compressed air supply 31 through the line 32 to the roto-chamber 33 at an input 34. The preferred embodiment of the invention uses a primary compressed air supply 26 and a secondary compressed air supply 31. A modification would involve only one compressed air supply, if sufficient for all purposes.

The roto-chamber 33 is a device containing a pneumatic piston 35 that is normally held in a position of retraction by the force exerted on the piston 35 by a coil spring 36 within the roto-chamber housing 37.

The piston 35 is connected mechanically to a flapper valve mechanism 38 by a rod 39. The flapper valve 38 is a mechanical assembly that is inserted intermediate the air intake line 22 and the air intake opening 23. The flapper valve 38 is located where it is capable of affecting the intake supply of air before the air enters the engine 11.

The flapper valve 38, as used by the present invention, has two positions of cooperative engagement with the air intake opening 23. In one position, the valve 38 is inserted well into the air intake line 22 to interfere with and to sufficiently attenuate the quantity of air passing through the air intake opening 23 to prevent further operation of the engine 11.

In the second position, the valve 38 is retracted from the air intake line 22 and, therefore, does not limit the quantity of air passing through the air intake opening 23 enough to affect operation of the engine 11. Since the flapper valve 38 is connected mechanically to the piston 35, the motion of the piston 35 produces a corresponding and proportional motion by the flapper valve 38.

When the piston 35 is in its retracted position, the flapper valve 38 is away from a position of interference with the air intake and, therefore, does not significantly restrict the amount of air passing through the air intake line 22 and entering the engine 11. Therefore, the engine 11 operates normally.

However, when a shutdown signal is generated on the connection 29, compressed air flows through the solenoid 30 to the roto-chamber 33 where it acts on the piston 35 urging it to overcome the downward force exerted by the spring 36, as viewed in FIG. 2.

In summary, the shutdown signal on the connection 29 of the methane monitoring control 20 actuates the shutdown solenoid 30 which, in turn, supplies compressed air from a secondary compressed air supply 31 through the shutdown solenoid 30 and to a roto-chamber 33. The compressed air urges the piston 35 in the rotochamber 33 to extend the rod 39 further out of the roto-chamber housing 37, which moves the flapper valve 38 to cut off the air flow through the air intake line 22 of the engine 11. This effectively shuts down the engine 11.

Some engines are difficult to shut down, such as a diesel engine, particularly when methane gas is present in sufficient quantities in the air supply, because the compression of the mixture within its cylinders raises the temperature to a degree sufficient to ignite the air-fuel mixture.

As such, no electrical spark is necessary to ignite the air-fuel mixture of the engine, and spark plugs become unnecessary to its continued operation. Therefore, in this situation, the engine cannot be shutdown by simply interrupting the electrical spark to the spark plugs. As long as a high compression, operating engine receives an adequate supply of fuel and air, it will continue to run, and in an environment that contains a combustible gas, it produces a real safety hazard.

In contrast, with other types of internal combustion engines, it is sometimes possible to stop engine operation by eliminating the spark which ignites the air-fuel mixture. However, even this is unreliable when the air-fuel mixture becomes volatile enough to be ignited by the normal compression stroke of the engine.

When methane gas is drawn into an internal combustion engine through the normal air intake, the resulting air-fuel mixture can become sufficiently volatile to be ignited merely by the relatively low compression of a non-diesel type of engine. When this occurs, an internal combustion engine that normally requires an electrical spark for operation can, nevertheless, experience a "run-away" condition, even when the electrical spark has been removed.

Heretofore, the only known way to shut down operation of a diesel engine near a natural gas well or an oil well has been to remove its fuel source. However, even if the fuel source of a diesel engine is removed, the engine will, nevertheless, experience a "run-away" condition when methane gas contaminates its fuel supply or enters through the air intake.

The above described difficulties are overcome by a system in accordance with the present invention.

The use of compressed air, to operate a horn or a mechanical device, to shut down an air flow, in an environment contaminated with dangerous levels of methane gas, are non-spark producing arrangements which further decrease the danger of igniting a combustible gas. This serves to lessen the likelihood of causing an explosion or fire while attempting to effect engine shutdown.

Internal combustion engines, whether fueled by diesel, gasoline, natural gas or propane gas, that operate at oil or natural gas well sites, can use the system of the present invention, because all such internal combustion engines need an ambient air supply to operate, and when that ambient air supply is interrupted, all such engines cease to operate.

The invention has been shown, described and illustrated in substantial detail with reference to the presently preferred embodiment. It will be understood by those skilled in this art that other and further changes and modifications can be made without departing from the spirit and scope of the invention which is defined by the claims appended hereto.

What is claimed is:

1. A methane monitor and engine shutdown system for use at oil well and natural gas well sites in cooperation with an internal combustion engine, comprising:

sensor means for detecting ambient concentration amount of methane gas, said sensor means responsive to said ambient concentration amount of methane gas;

said sensor means continually providing an indication of said ambient concentration amount of methane gas to a control unit;

said control unit being adapted to provide a first signal upon said ambient concentration amount of methane gas exceeding the lower of two predetermined threshold settings;

said first signal being connected to open a pneumatic valve to permit compressed air to flow from a compressed air storage means through said pneumatic valve to an air horn to provide an audible signal;

said control unit being adapted also to provide a second signal upon said ambient concentration amount of methane gas exceeding the higher of said two predetermined threshold settings;

said second signal being connected to open a second pneumatic valve to permit compressed air to flow from a second compressed air storage means through said second pneumatic valve to a roto-chamber to provide mechanical movement within said roto-chamber;

said roto-chamber attached to air intake valve means of said internal combustion engine for obstructing the intake of ambient air by said mechanical movement within said roto-chamber;

said roto-chamber including a piston connected through a rod with said air intake valve means; spring means for urging said piston to move said air intake valve means to a first normal fully open position providing non-interference to the intake of ambient air by said engine;

whereby upon the occurrence of said second signal said mechanical movement within said roto-chamber is adapted for urging said piston for movement against said spring means away from said first normal fully open position into a second fully closed position providing substantial interference to said intake of ambient air by said engine thereby resulting in the safe shutdown of said engine; and wherein said sensor means is located in close proximity to said intake of ambient air by said engine and said system does not produce an electrical arc that is exposed to said ambient concentration amount of methane gas.

2. The methane monitor and engine shutdown system of claim 1 wherein said compressed air storage means is sufficient to furnish a supply of compressed air through said pneumatic valve and through said second pneumatic valve thereby eliminating said second compressed air storage means.

3. The methane monitor and engine shutdown system of claim 1 wherein said system includes pneumatic means for generating an audible warning to indicate the occurence of said methane gas concentrations rising above said lower of said two predetermined threshold settings.

4. The methane monitor and engine shutdown system of claim 1 wherein said system includes pneumatic means for generating mechanical motion to obstruct the intake of said ambient air by said engine upon the occurrence of said methane gas concentrations rising above said higher of said two predetermined threshold settings.

5. The methane monitor and engine shutdown system of claim 1 wherein said system is mounted directly to said engine.

* * * * *